United States Patent [19]

Singer

[11] 4,384,370

[45] May 24, 1983

[54] GOWN WITH STERILE BACK CLOSURE

[75] Inventor: Wayne J. Singer, Appleton, Wis.

[73] Assignee: Kimberly-Clark Corporation, Neenah, Wis.

[21] Appl. No.: 283,200

[22] Filed: Jul. 14, 1981

[51] Int. Cl.[3] ..... A41B 9/00; A41B 13/10

[52] U.S. Cl. ..... 2/114; 2/51

[58] Field of Search ..... 2/114, 51, DIG. 7; 128/156, 157, 158

[56] References Cited

U.S. PATENT DOCUMENTS

| | | | |
|---|---|---|---|
| 2,707,282 | 5/1955 | Paterson | 2/114 |
| 3,011,172 | 12/1961 | Tames | 2/51 |
| 3,359,569 | 12/1967 | Rotanz et al. | 2/114 |
| 3,570,012 | 3/1971 | Winters | 2/114 |
| 3,594,818 | 7/1971 | Planner | 2/114 |
| 3,609,767 | 10/1971 | Grosz | 2/114 |
| 3,648,290 | 3/1972 | Hartigan | 2/114 |
| 3,721,999 | 3/1973 | Goya et al. | 2/114 |
| 3,824,625 | 7/1974 | Green | 2/114 |
| 3,935,596 | 2/1976 | Allen, Jr. | 2/114 |
| 3,977,025 | 8/1976 | Horan | 2/114 |
| 3,988,781 | 11/1976 | Horan | 2/338 |
| 4,000,521 | 1/1977 | Zoephel et al. | 2/114 |
| 4,016,604 | 4/1977 | Welke | 2/51 |
| 4,019,207 | 4/1977 | Newman | 2/51 |
| 4,075,716 | 2/1978 | Collins | 2/114 |
| 4,214,310 | 7/1980 | Belkin | 2/114 |

*Primary Examiner*—Doris L. Troutman

*Attorney, Agent, or Firm*—Leydig, Voit, Osann, Mayer and Holt, Ltd.

[57] ABSTRACT

A back opening gown is disclosed in which the wearer can achieve a sterile back without assistance. The gown comprises a body portion having a front and a back with the back having a first and second panel and wherein the first panel has a flap running lengthwise of the gown. Prior to closure, the flap is folded back over the first panel and preferably releasably secured thereto. After any initial securing of the gown has been completed, e.g., snapped at the neck, an assistant secures the free end of a first belt tie attached to the flap to the rearward end of a belt disposed in a protective belt cover or housing. The wearer then pulls on the forward end of said belt, thereby releasing the flap and covering the non-sterile portions of the back of the gown and pulling the first belt tie and the rearward end of the belt under the belt cover or housing. The forward end of the belt is then secured to a second belt tie on the front portion of the gown. In the manner described, a sterile back is achieved.

12 Claims, 6 Drawing Figures

GOWN WITH STERILE BACK CLOSURE

BACKGROUND OF THE INVENTION

Field of the Invention

The present invention relates generally to gowns where sterility is required and, more particularly, to gowns adapted for use in hospitals, specifically surgical gowns used by members of operating teams. It is highly desirable that the back of the gown as well as, obviously, the front, be sterile. This, in the past, has in general required two people, the wearer and an assistant. The subject invention allows the achievement of a sterile back on the gown by the wearer alone after the initial step of securing any inner closure means has been completed.

SUMMARY OF THE INVENTION

The invention is directed to a back opening gown in which the wearer can achieve a sterile back without assistance. The gown comprises a body portion having a front and a back. The back has a first and second panel. One of the panels has a flap running lengthwise of the gown. Prior to closure, the flap is folded back upon the panel to which it is attached and preferably releasably secured thereto. After any initial securing of the gown has been completed, e.g., snapped at the neck, an assistant secures the free end of a first belt tie attached to the flap to the rearward end of a belt disposed in a protective belt cover or housing. The wearer then pulls on the forward end of said belt, thereby releasing the flap and covering the non-sterile portions of the back of the gown. The first belt tie and the rearward end of the belt are pulled under the belt cover or housing at the same time. The forward end of the belt is then secured to a second belt tie on the front portion of the gown, completing closure of the gown. In this manner, a sterile back is obtained.

DESCRIPTION OF THE PREFERRED EMBODIMENT

While the invention will be described in connection with a preferred embodiment, it will be understood that it is not intended to limit the invention to that embodiment. On the contrary, it is intended to cover all alternatives, modifications and equivalents as may be included within the spirit and scope of the invention.

Figure 1:
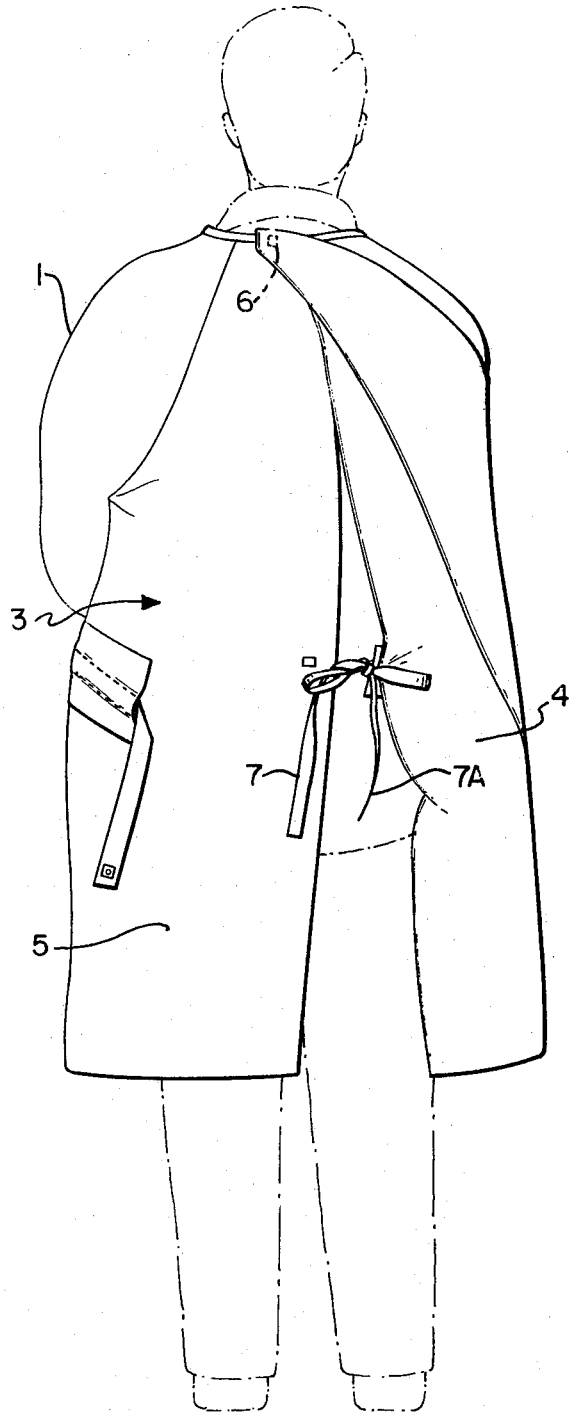
FIG. 1 is a back view of the gown of the present invention illustrating the flap in its folded position but pulled back to show an internal tie.
Figure 2:
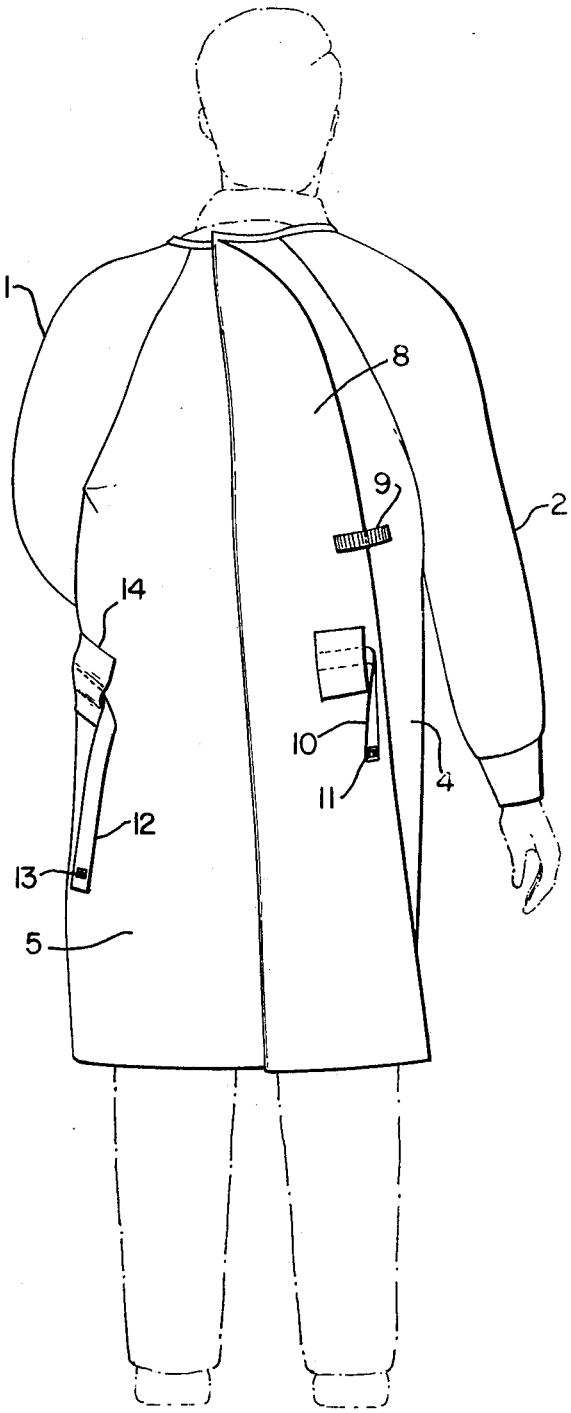
FIG. 2 is a back view of the gown of the present invention illustrating the flap in the folded position prior to unfolding.

Turning now to the drawings and referring first to FIGS. 1 and 2, the gown has two sleeves 1 and 2 and a body portion 3 having a closed front section (see FIG. 6) and an open back section having two panels, a right panel 4 and a left panel 5 (when viewed from the rear). Thus the gown is of the back closing type with the two back panels 4 and 5 being divided from each other along the length of the gown.

Figure 5:
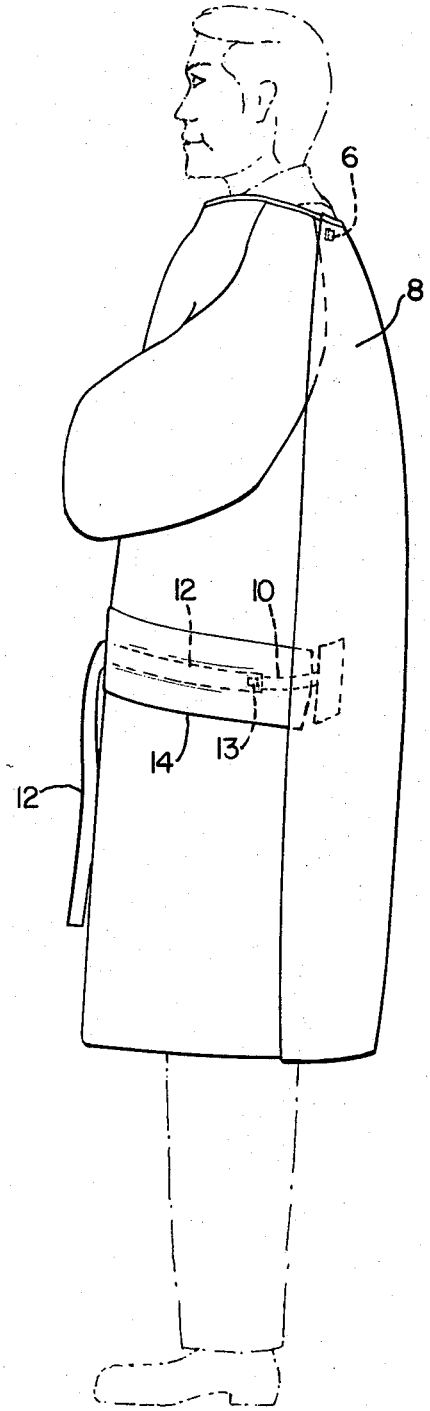
FIG. 5 is a side view of the gown of the present invention illustrating the flap in the closed position.

For purposes of closing the gown at the neck, a snap 6 may be used as illustrated in FIGS. 1 and 5. Alternatively, other closures, such as Velcro or tie strings may be provided on the opposed surfaces at the top edges of the two back panels. (For a more complete description of the type of fastener identified as Velcro, see U.S. Pat. No. 3,824,625 at column 2, lines 38–48.) A second closure means, such as the two ties indicated at 7 and 7A in FIG. 1, is preferably used to secure the two back panels together, preferably at about waist level. Both closure means 6 and ties 7 and 7A may be secured by a non-sterile member of the operating team prior to completion of the closure and the formation of a sterile back.

As can be seen in FIG. 2, a flap 8 forms a portion of the right panel 4. (In FIG. 1 this flap has been pulled back to show ties 7 and 7A.) In FIG. 2, flap 8 is shown in its normal folded position after completion of the initial closure of the back, i.e., with neck snap 6 and ties 7 and 7A. Flap 8 is retained in its folded position by releasable means 9, preferably a scored or grooved tape which will separate along a groove upon the application of a pulling force. FIG. 2 also discloses belt tie 10 secured at one end to what will become the internal surface of the flap upon closure. In the folded position of flap 8 illustrated in FIG. 2, belt tie 10 is attached to the exposed surface of flap 8 near the free edge of the flap. The free end of belt tie 10 preferably contains a fastening means 11, preferably a snap. Alternatively, belt tie 10 can be secured to belt 12 by tying the two together by use of Velcro fasteners or by other suitable means. For the reasons hereinafter discussed, the knot formed in this first alternative technique must be small enough to fit in belt cover or housing 14. Also visible in FIG. 2 is the rearward end of belt 12 to which is attached closure means 13, also preferably a snap, adapted for use with closure means 11 on belt tie 10.

Belt 12, of which the rearward end is visible in FIG. 2, is enclosed in a belt cover or housing 14, preferably located at about waist level.

Figure 3:
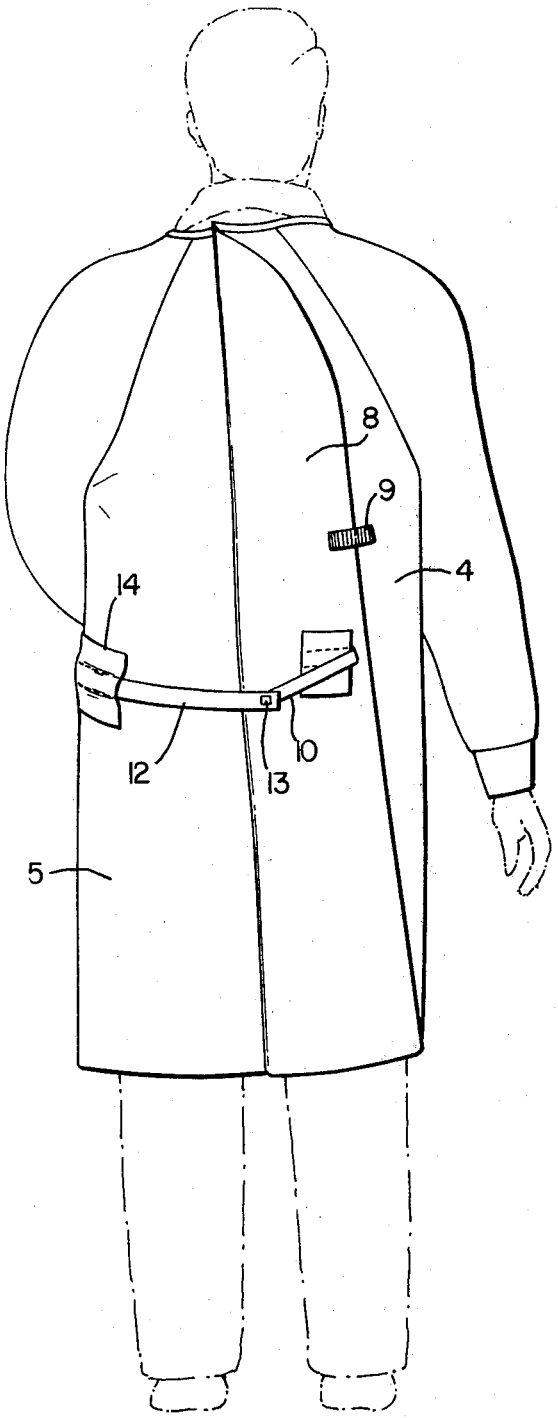
FIG. 3 is a back view of the gown of the present invention in which the belt has been connected to the belt tie secured to the flap.

In FIG. 3, the securing of belt tie 10 to the rearward end of belt 12 via snaps 11 and 13 is illustrated. In FIG. 3, flap 8 is still in the folded position secured to right panel 4 by notched tape 9.

Figure 4:
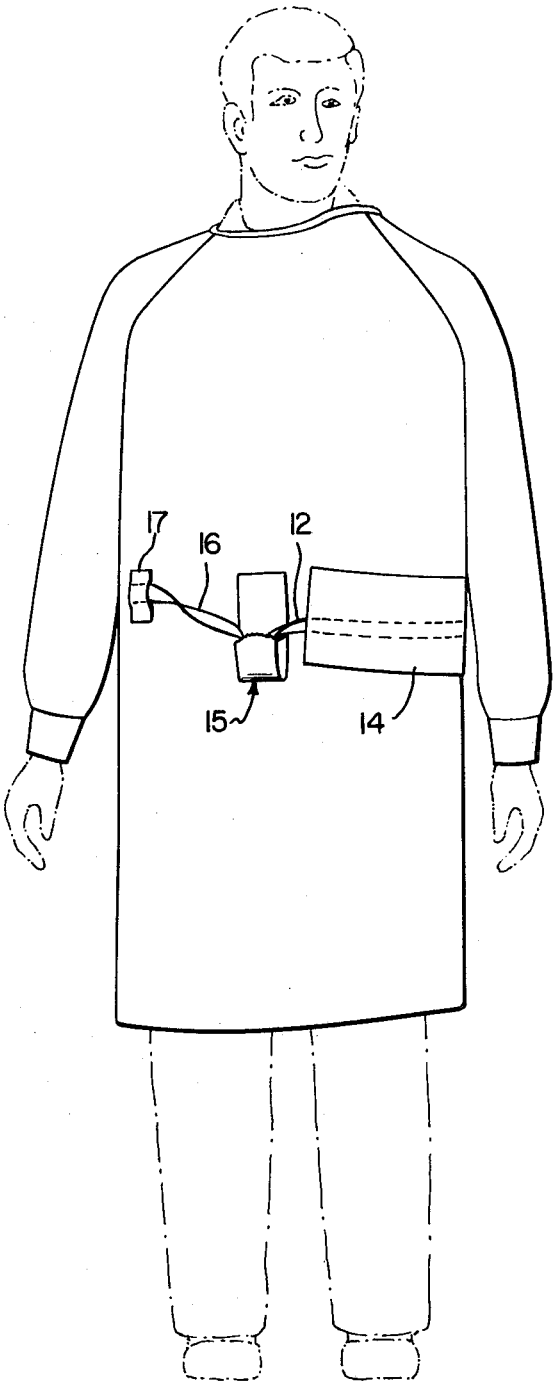
FIG. 4 is a front view of the gown of the present invention illustrating, in a preferred embodiment, the "ready to use" state prior to securing the belt to the front belt tie.

In FIG. 4, a front view of the gown, a forward exposed end of belt 12 is shown protruding from belt cover or housing 14. The free end of the forward part of belt 12 is located in pouch 15, which acts as a convenient storage place for the free ends of both belt 12 and belt tie 16. The other end of belt tie 16 is secured to the front portion of the gown as shown at 17.

FIG. 5 shows flap 8 released from its folded position and covering left panel 5 to form the desired sterile back. A side view of belt cover or housing 14 is also shown.

Figure 6:
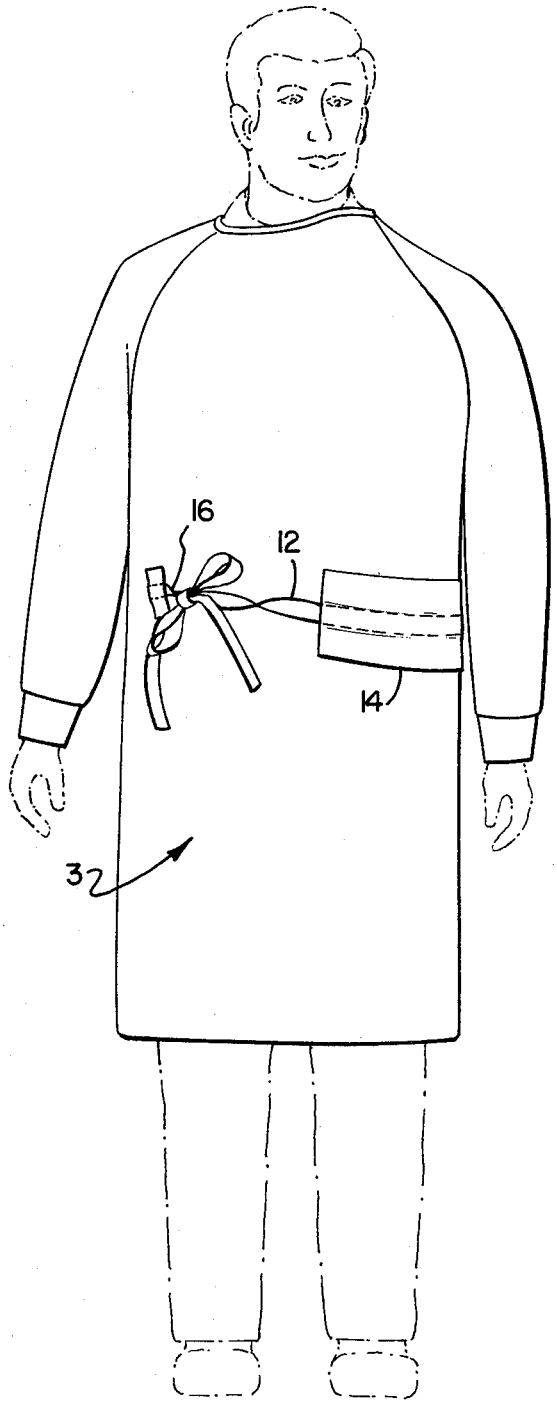
FIG. 6 is a front view of the gown of the present invention illustrating a preferred embodiment of the present invention, the gown being fully closed and secured in that position.

The closure and formation of the sterile back as shown in FIGS. 5 and 6 is accomplished by the wearer of the gown pulling on the forward exposed end of belt 12 to separate scored tape 9 along a score or groove thereof, thereby bringing flap 8 over across and covering left panel 5. The forward free end of belt 12 is then secured by the wearer of the gown to belt tie 16, thereby securing flap 8 in the closed position and achieving the desired sterile back. Simultaneously with the pulling on the forward end of belt 12 which results in flap 8 covering left panel 5 to form the sterile back, the non-sterile portions of belt tie 10 and the rearward end of belt 12 (see FIGS. 3 and 5) are pulled under the protective belt cover or housing 14, thereby assuring the sterility of the gown. It should be noted that a portion of belt tie 10 may not be under belt cover or housing 14 but is under flap 8 as illustrated by dotted lines in FIG. 5. In this manner, a sterile back is obtained.

The present invention is particularly useful with disposable or limited use gowns, albeit it is also useful with reusable gowns. Material useful in making gowns of the subject invention include, by way of example, cotton, reinforced nonwoven fabrics or any woven or nonwoven fabric recognized in the art as appropriate for the manufacture of surgical or operating room gowns.

An important feature of this invention is that the lengths of belt tie 10 and belt 12, particularly the length of the exposed portion of the rearward end of belt 12, are such that, in combination with the length and positioning of belt tie 16, all potentially contaminated rearward portions of belt 12 and belt tie 10, are covered by either the belt cover or housing 14 or flap 8. A desirable way of insuring this at the time the wearer secures the sterile back is to have the rearward portion of the belt 12 (which is exposed and potentially handled by the non-sterile assistant when securing it to belt tie 10) and optionally, belt tie 10, of a different color than the belt material which is not exposed to the non-sterile assistant. Alternatively, belt 12 can be notched or other indicia, e.g., a line, marked thereon at the point where it is exposed at the rearward end of belt cover 14 prior to closure of the gown.

As discussed above, belt 12 and belt tie 10 can be tied together. However, since the belt and belt tie are at least in part covered by belt cover or housing 14 when the gown is secured in a closed position, the knot formed must be small enough to fit within the belt cover or housing 14.

In addition, flap 8 need not be located on right panel 4, but can be located on left panel 5. The location of the operative parts of the closure system, e.g., belt 12, belt tie 16 and belt tie 10, as well as the belt cover or housing 14 and releasable means 9 will, of course, also be reversed. As noted above, flap 8 is preferably releasably secured to panel 4 prior to closure by a notch tape 9 or other means. This is not required if the folding of flap 8 back over onto panel 4 results in the flap lying flat and being maintained in that position during the preliminary stages of donning the gown.

Belt tie 10 is preferably secured at one end to the surface of flap 8 near the free edge of the flap, as shown in FIGS. 2 and 3. It is not essential that belt tie 10 be secured near the free edge as long as the placement is such that pulling on belt 12 (after the fastening of belt tie 10) will result in flap 8 covering left panel 5 and the non-sterile portions of belt tie 10 and belt 12 are covered by flap 8 or belt cover or housing 14.

Preferably the belt, belt ties, the pouch and the belt cover or housing are all made of the same material as the body of the gown. This facilitates manufacture and subsequent sterilization of the gown. It should be noted, however, that other materials may be used for any or all of these items, if desired.

As can be seen from the foregoing detailed description, the present invention provides an improved method of donning a sterile gown and obtaining a sterile back without the assistance of a second person.

I claim:

1. A back opening gown comprising:

a body portion having sleeves attached thereto;

said body portion having a front portion and a back portion;

said back portion having a first panel and a second panel;

said front portion and said back portion together defining a neck opening;

said first panel having a flap running lengthwise of the gown;

a protective belt cover on said front panel and extending around the side of said gown to said second panel;

a first belt tie attached at one end to the surface of said flap which is exposed when said flap is folded back over said first panel;

a belt of sufficient length to extend through said belt cover and having exposed end portions at both the forward and rearward ends of said belt cover;

means for securing the rearward end of said belt and the free end of said first belt tie together;

a second belt tie secured at one end to said gown and of sufficient length to secure the free end thereof to the forward exposed end of said belt;

said belt, said first belt tie, said second belt tie and said protective belt cover so constructed and arranged that, upon closure of said gown, the previously exposed rearward end of said belt and said first belt tie are completely covered by said protective belt cover or said flap; and said gown adapted to be secured by the wearer in a closed position with a sterile back without assistance.

2. The gown of claim 1 further comprising means for releasably securing said flap folded back over said first panel.

3. The gown of claim 2 wherein said means for releasably securing said flap is a scored or grooved tape.

4. The gown of claim 1 wherein said flap is folded back over said first panel and releasably secured to said first panel.

5. The gown of claim 1 further comprising closure means for said neck opening.

6. The gown of claim 1 further comprising a pouch located on the front of said gown at about waist level for receiving (1) the free end and a portion of said second belt tie and (2) the free end and a portion of said forward exposed end of said belt.

7. The gown of claim 1 wherein said first panel is the right panel of said gown and said second panel is the left panel of said gown, when viewed from the rear.

8. The gown of claim 1 wherein said gown is disposable.

9. The gown of claim 1 wherein said belt cover and said first and second belt ties are all located on said gown at about waist level.

10. The gown of claim 1 wherein the rearward exposed end of said belt is a different color than the rest of said belt.

11. The gown of claim 1 wherein said belt is marked at the point where prior to closure said belt is exposed at the rearward end of said belt cover.

12. The gown of claim 1 wherein said first belt tie is attached to the surface of said flap near the free edge of said flap.

* * * * *